US005464046A

United States Patent [19]

McIntyre et al.

[11] Patent Number: 5,464,046

[45] Date of Patent: Nov. 7, 1995

[54] ELECTRICALLY CONTROLLED JACQUARD SELECTION APPARATUS

[75] Inventors: Jonathan F. McIntyre, Tyne & Wear; Malcolm G. B. Mahboubian-Jones, Newcastle-upon-Tyne; Ian Turnbull, Sunderland, all of England

[73] Assignee: Bonas Machine Company Limited, Gateshead, United Kingdom

[21] Appl. No.: 297,236

[22] Filed: Dec. 5, 1994

[30] Foreign Application Priority Data

Apr. 19, 1994 [GB] United Kingdom ..... 9407710

[51] Int. Cl.[6] ..... D03C 3/20

[52] U.S. Cl. ..... 139/455; 66/218

[58] Field of Search ..... 139/455; 66/218

[56] References Cited

U.S. PATENT DOCUMENTS 5,027,619 7/1991 Saito ..... 139/455 X 5,183,081 2/1993 Kuster et al. ..... 139/455 X

FOREIGN PATENT DOCUMENTS 3705738 9/1988 Germany ..... 139/455

*Primary Examiner*—Andy Falik

*Attorney, Agent, or Firm*—Dann, Dorfman, Herrell and Skillman; Henry H. Skillman

[57] ABSTRACT

An electrically controlled jacquard apparatus capable of selectively controlling individual warp yarns. Each warp yarn is controlled by a selector body which is engaged by at least two and preferably three parallel support members and is adapted to be reciprocated by sliding longitudinally of the support members. One of the support members is static and the other two support members are reciprocated longitudinally out-of-phase with each other. The selector body is selectively latched to the three members so as to be moved in either direction or to be supported at a static position.

11 Claims, 7 Drawing Sheets

ELECTRICALLY CONTROLLED JACQUARD SELECTION APPARATUS

FIELD OF THE INVENTION

The present invention relates to an electrically controlled jacquard apparatus; in particular a jacquard apparatus which is capable of selectively controlling individual warp yarns.

BACKGROUND OF THE INVENTION

Maximum pattern flexibility can be achieved on a loom if each individual warp yarn can be independently moved to a selected shed position.

Difficulties arise in independently controlling individual warp yarn in warp sheets having a high density of yarns; eg. density of warp yarns in excess of 15 warp ends per cm. The greater the warp yarn density, the greater the difficulty.

The difficulty arises due to the large number of warp yarns and the limited space available for the jacquard apparatus.

SUMMARY OF THE INVENTION

It is a general object of the present invention to provide a jacquard apparatus capable of controlling individual warp yarns in a warp sheet having a density in excess of 15 warp ends per cm.

According to one aspect of the present invention there is provided a jacquard mechanism for controlling shed selection of warp yarns, the mechanism including at least one selector body adapted for connection to a heald and mounted for movement between upper and lower shed positions, a plurality of elongate support members arranged side by side in a parallel relationship, the selector body being slidably mounted relative to said support members for longitudinal movement therealong, at least one of said plurality of support members being static and at least one other of the plurality of support members being mounted for longitudinal reciprocal movement, the selector body and support members including co-operable latch means operable between latch and unlatch positions causing selective engagement therebetween.

Preferably said plurality of elongate support members comprises a static support member and a pair of reciprocally mounted support members, the support members of said pair being reciprocated out of phase.

Preferably the selector body is elongate and is polygonal in cross-section, preferably triangular. In the case of a triangular cross-section, the selector body slidingly engages the support members at the apices of the cross-section.

Preferably the jacquard mechanism includes a plurality of selector bodies and associated support members, the selector bodies being arranged to be slidingly received on common support members to which other selector bodies are slidably connected.

Preferably the cross-sectional shape of the selector bodies and location of the support members is chosen to define a tessellated assembly.

Preferably the density of selector bodies is in the region of 41,600 per square meter.

Preferably each selector body is connected to an individual heald for controlling the shed position of an individual warp end.

The co-operable latch means preferably comprises a movable latch member mounted on the selector body or support member and a static latch formation on the support member or selector body respectively.

Various aspects of the present invention are hereinafter described, with reference to the accompanying drawings, in which:

DESCRIPTION OF THE PREFERRED EMBODIMENTS

Figure 1:
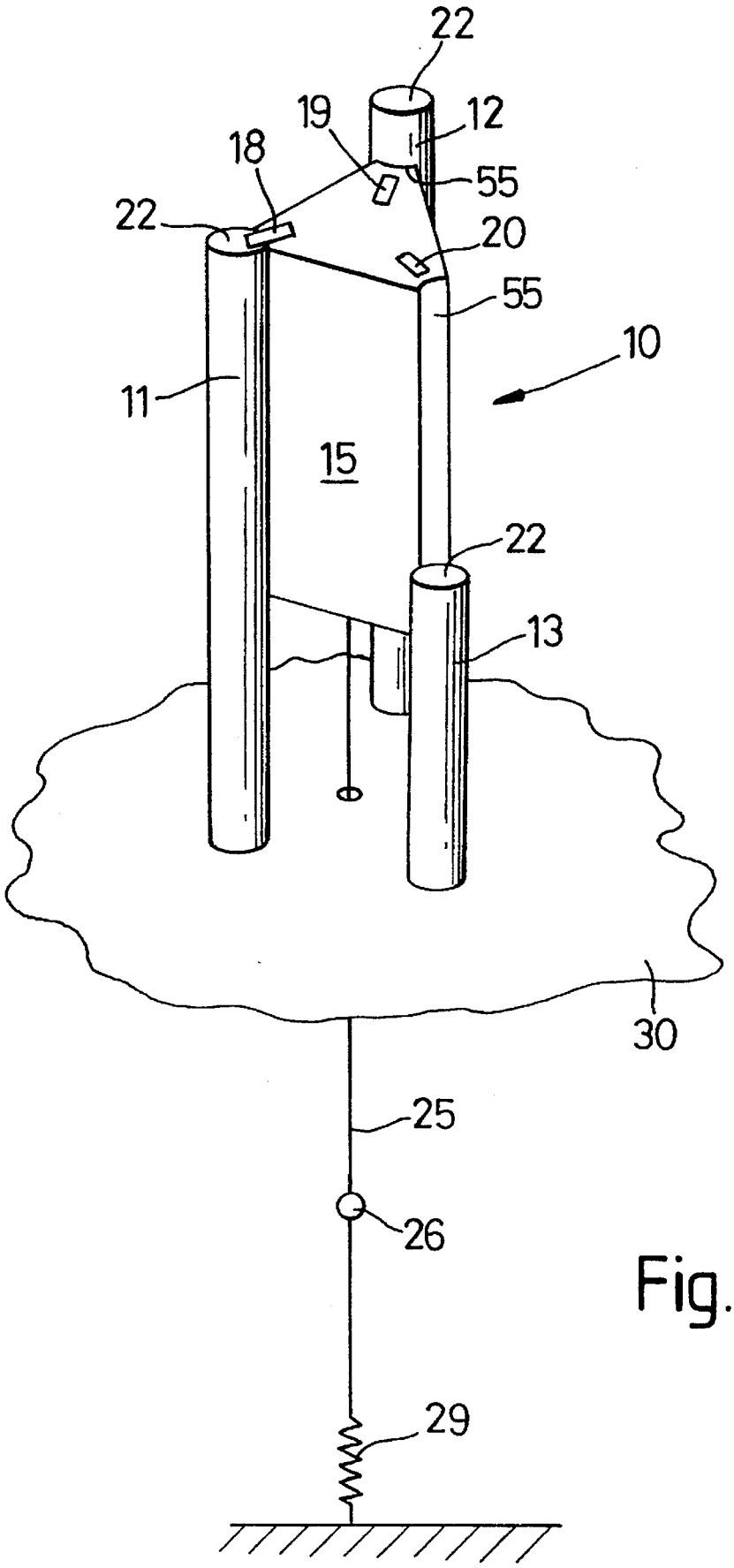
FIG. 1 is a schematic illustration of a selector for controlling movement of an individual warp yarn, the selector being shown at top shed position.

Referring initially to FIG. 1, there is shown a selector 10 located between three guide elongate support members in the form of pins 11, 12 and 13. The pins 11, 12 and 13 may be made from any suitable non-deformable material which is relatively rigid; a metal such as steel, or a suitable plastics material may be used.

The selector 10 has a body 15 which is generally of elongate form and is generally triangular in cross-section.

The selector body 15 is arranged such that it is slidably mounted in a longitudinal direction on the pins 11, 12 and 13. In this respect, a longitudinally extending groove 55 is provided at each apex of the triangular cross-section which slidably engages a respective pin 11, 12 or 13.

One of the pins is arranged to be stationary whilst the other two pins are arranged to reciprocate longitudinally between upper and lower positions out of phase by 180°. In the illustrated example, pin 11 is stationary, and pins 12, 13 reciprocate.

The selector body 15 houses three movable latches 18, 19 and 20 for respective latching engagement with pins 11, 12 and 13. The latches 18, 19 and 20 are moved between retracted and extended positions by electronically controlled motive means (not shown in FIG. 1) housed within body 15. The motive means may be in the form of an electrostrictive or piezo-electric strip.

A single motive means is preferably provided for each latch 18, 19 and 20.

The pins 11, 12 and 13 are each provided with latch formations for cooperation with latches 18, 19 and 20. Preferably the latch formations comprise the upper end face 22 of the respective pins. The end face 22 may be recessed, for example of conical shape, to define a peripheral knife edge for engagement with latches 18, 19 and 20. Alternatively the latch formation on each pin may be spaced from the end of the pin and be defined by a peripheral groove.

The selector body 15 is attached at one end to a cord 25 which in turn is connected to a heald 26; the heald 26 being biased toward a bottom shed position by a spring 29.

The pins 11, 12 and 13 pass through a support board 30 and in the bottom shed position, the selector body 15 rests upon board 30.

The selector body 15 is moved to an upper shed position (as seen in FIG. 1) by actuating an appropriate latch 19 or 20 to move to an extended position to engage the appropriate pin 12 or 13 which is about to move toward its upper position.

In FIG. 1, pin 12 is shown at its uppermost position and pin 13 is shown at its lowermost position. The body 15 is held at its upper shed position by latch 18 engaging the upper face 22 of pin 11. In order to move the body 15 to the position shown from its bottom shed position and using pin 12, the following sequence occurs:

Prior to pin 12 rising to its uppermost position, latch 19 is moved to its extend position to engage the upper face 22 on pin 12 and the body 15 is thereby raised. The lowermost position of face 22 on pins 12 and 13 is located below the height of latches 19 and 20 when the body 15 is at its bottom shed position. Accordingly actuation of a latch 19 or 20 to move it to its extended position may occur at any time during the period of time taken for the associated pin to fall below the latch as it moves to its lowermost position and then rise to the height of the latch as it begins its upward stroke towards its uppermost position.

The uppermost position of face 22 of pins 12 and 13 is located above the face 22 on pin 11.

Accordingly as the body 15 is raised by pin 12, latch 18 is raised above face 22 on pin 11 as the pins 12 or 13 approaches the end of its upward stroke.

Latch 18 may therefore be actuated to move to its extended position at any time during the time period taken for the pin 12 (or 13) to raise latch 18 above the face 22 on pin 11 and then subsequently lower the latch 18 to the height of face 22 on pin 11.

As the body 15 is lowered with its latch 18 extended, latch 18 engages face 22 on pin 11 and holds the body 15 at its upper shed position as shown in FIG. 1. Disengagement between latch 19 and its associated pin 12 is automatically achieved as pin 12 continues on its downward stroke. Latch 19 may be moved to its retracted position at any time before pin 12 rises to the height of latch 19 on its next upward stroke.

When it is desired to move body 15 to its lower shed position, latch 19 or 20 is extended to engage either pin 12 or 13 as it travels on its upward stroke toward its uppermost position. End face 22 of the rising pin contacts the extended latch and raises the body 15. This causes the latch 18 to lift off face 22 on pin 11. Latch 18 is then retracted before it is lowered to the height of face 22 on pin 11 so that body 15 can continue its downward movement to its lower shed position.

When the body engages board 30, the latch 19 or 20 is automatically disengaged from the associate pin 12 or 13 as the pin continues on the downward stroke to its lowermost position.

Figure 2:
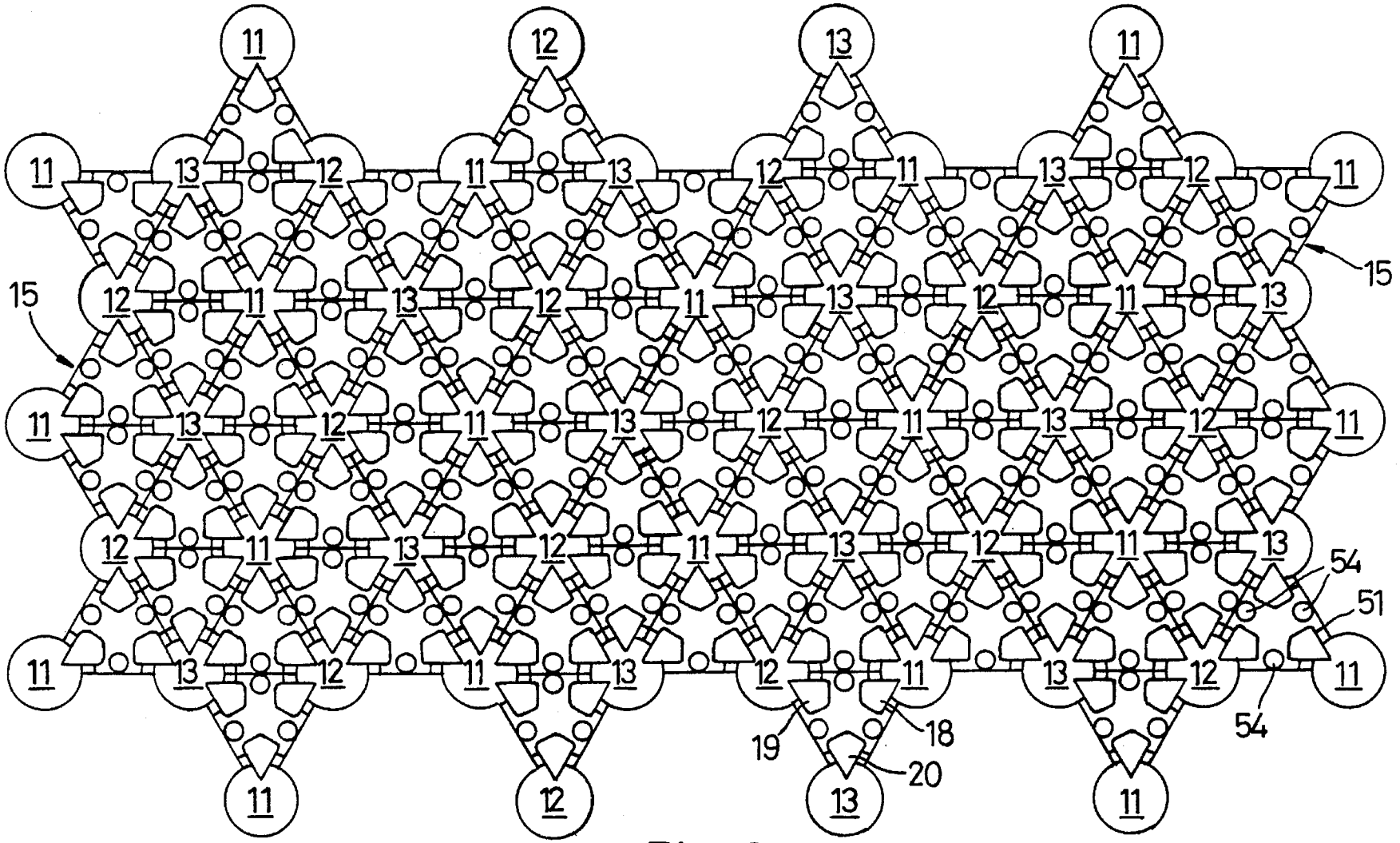
FIG. 2 is a plan view of a plurality of selectors arranged in a jacquard apparatus.

In FIG. 2 there is illustrated a plan view of a jacquard apparatus including a plurality of selector bodies 15. The bodies 15 are of triangular cross-section and are arranged in a tessellated manner. In this way, a high number of selector bodies 15 may be accommodated in a limited amount of space.

In the embodiment illustrated in FIG. 2, each pin 11, 12 or 13 is about 8 mm in diameter and their axes are space apart by about 17 mm. Thus, in an area of about 8850 sq mm there are 68 selector bodies. With such an arrangement it is possible in an area of about 0.6 $M^2$ to accommodate 25000 selector bodies 15 and associated pins 11, 12 and 13; this equates to approximately 41,000 selectors per square meter.

Figure 3:
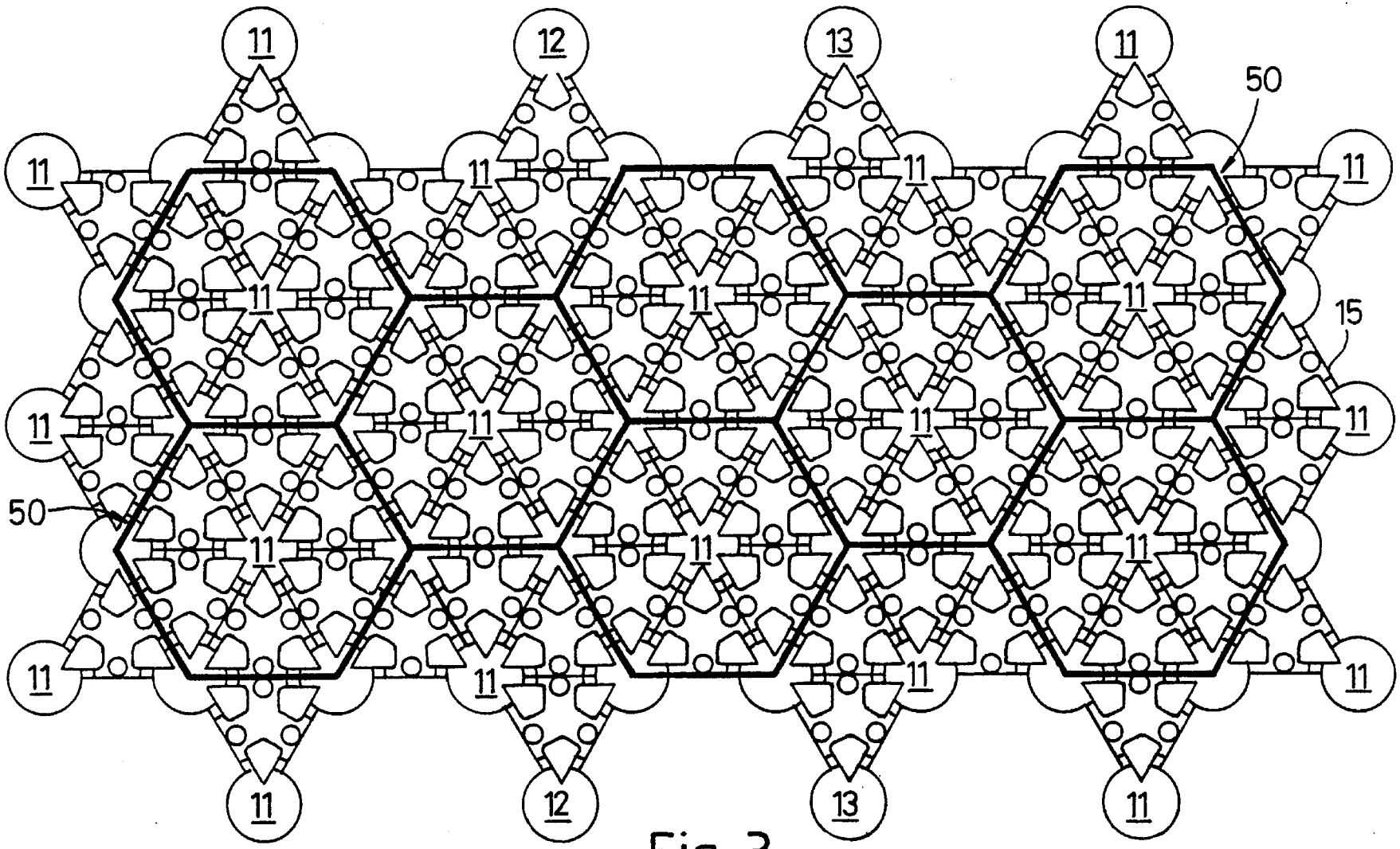
FIG. 3 is the same plan view as FIG. 2 highlighted to show the arrangement of the selectors into hexagonal assemblies.

The pins 11, 12, 13 are located at the apices of the triangular bodies 15 and the bodies 15 are arranged in groups of six to define a series of hexagonal assemblies 50 (shown schematically in FIG. 3). A static pin 11 is located at the center of each hexagonal assembly 50 and so each of the six bodies 15 surrounding that pin 11 may be latched thereon in order to be maintained at its upper shed position. Complete hexagonal assemblies 50 are not formed at the periphery of the tessellated assembly.

Similarly, internally of the tessellated assembly, each pin 12 and each pin 13 is surrounded by six selector bodies 15. Accordingly, during any weaving cycle, each selector body 15 may be independently latched on to an associated pin 11, 12 or 13 so as to be independently moved between upper and lower shed positions or retained at these positions.

Figure 4:
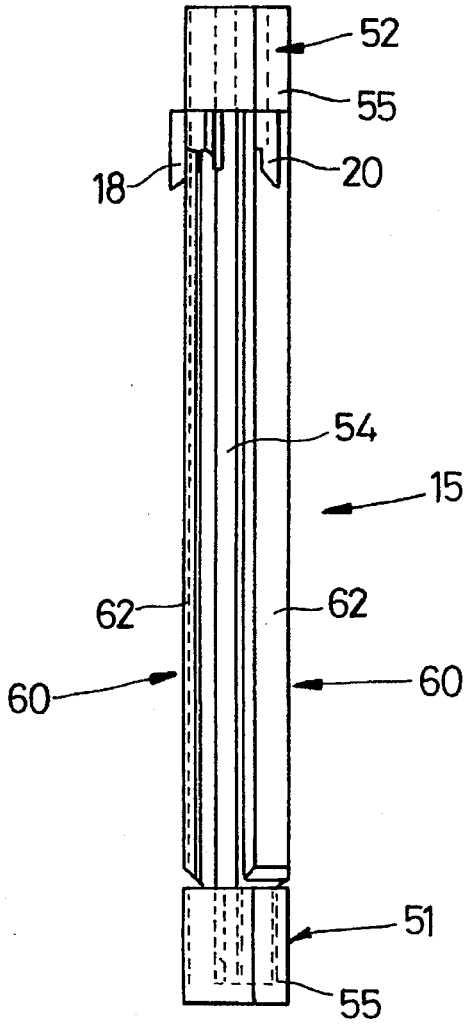
FIG. 4 is a detailed side view of a selector according to one embodiment of the present invention and as shown in FIG. 3.

As more clearly seen in FIG. 4, each selector body 15 preferably comprises a lower body portion 51 which is spaced from and secured to an upper body portion 52 by a series of struts 54. The upper and lower body portions 51, 52 are preferably moulded from a suitable plastics material and are each of triangular cross-section.

A groove 55 is located at the apex of each body portion 51, 52 for sliding engagement with associated pins 11, 12 and 13. The interconnecting struts may be formed from a suitable plastics material or metal.

Each latch 18, 19 and 20 is mounted on an upper end of a deflectable elongate support 60. The support 60 is mounted at its lower end on the lower body portion 15. An electrostrictive or piezo-electric strip 62 is associated with the support 60 to cause the upper end of the support 60 to be deflected outwardly and so move the latch mounted thereon to its extended position. The elongate support 60 may be resilient so as to bias the latch carried by the support 60 to its retracted position.

Figure 5:
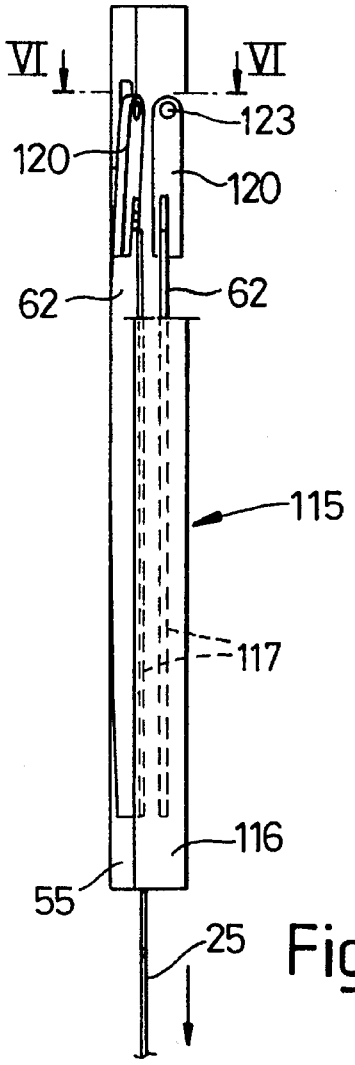
FIG. 5 is a broken away side view of a selector according to another embodiment of the present invention.
Figure 6:
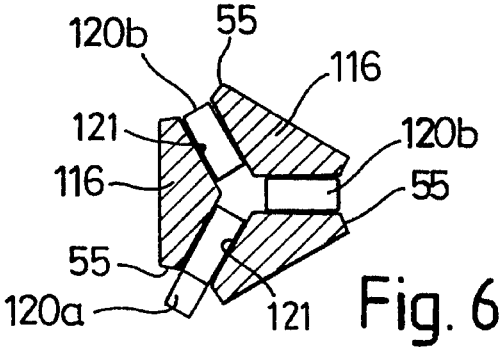
FIG. 6 is a sectional view taken along line VI—VI in FIG. 5.

In FIGS. 5 and 6 an alternative selector body 115 is illustrated; parts similar to those in the embodiment of FIG. 4 have been designated by similar reference numerals.

The selector body 115 includes a unitary elongate body 116 including recessed grooves 117 located at the bottom of grooves 55 for accommodating an electrostictive or piezo-electric strip 62. A movable latch 120 is associated with each strip 62; each latch 120 being pivotally mounted in an associated slot 121 formed in the body 117 via a pivot 123.

Each latch 120 is connected to one end of the associated strip 62 so as to be movable between a retracted, non-latching position (as indicated by latch 120*a*) and an extended, latching, position (as indicated by latch 120*b*).

As illustrated, each strip 62 engages its associated latch 120 at the terminal end of the latch 120 remote from pivot 123. It is envisaged that the strip 62 could engage the latch 120 at a position closer to the pivot 123, this provides the advantage of amplifying the displacement of the terminal end of the latch 123 in relation to the displacement of the end of the strip 62.

In the embodiments disclosed in relation to FIGS. 1 to 6, the selector body is provided with a movable latch for co-operation with a static latch formation on the support members 11, 12 and 13.

Figure 8:
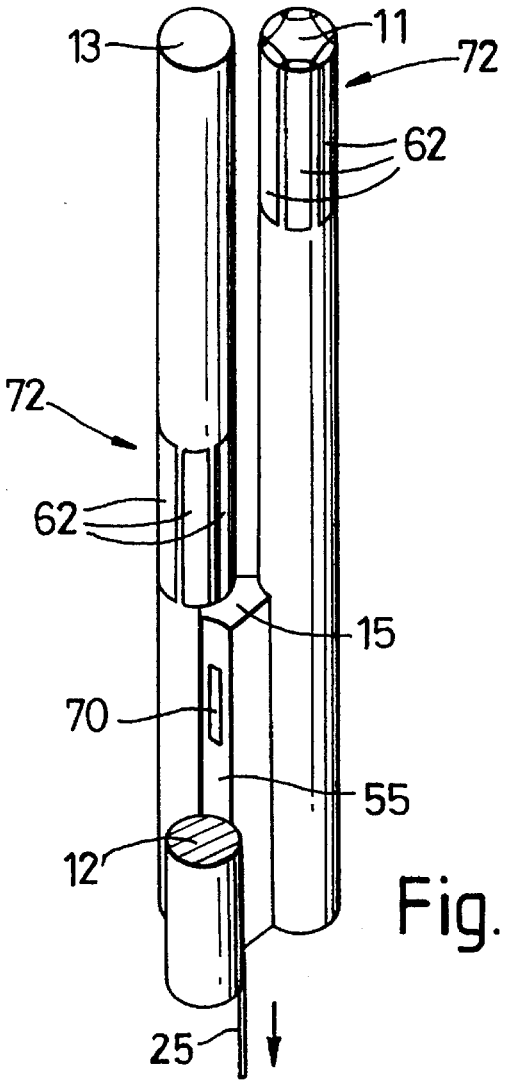
FIG. 8 is a schematic illustration similar to FIG. 1 of an alternative embodiment according to the present invention.
Figure 9:
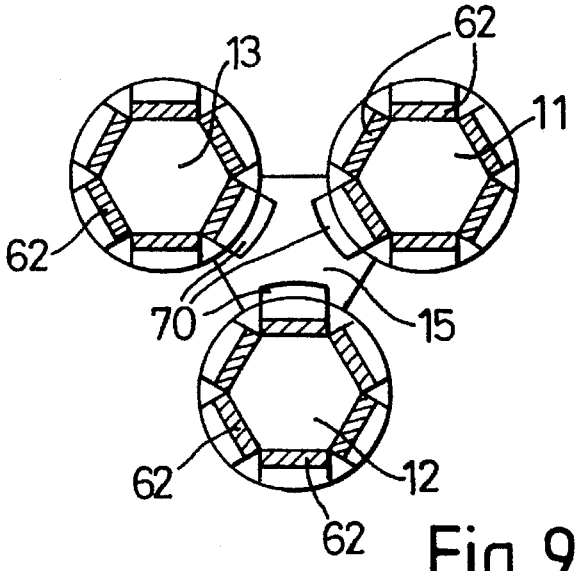
FIG. 9 is a plan view of the embodiment shown in FIG. 8.

Alternatively, it is envisaged that the movable latch may be provided on the support members for co-operation with static latch formations on the selector body. An embodiment in which the movable latches are mounted on the support members 11, 12, 13 is illustrated in FIGS. 8 and 9. In FIG. 8, the pins 11, 12 and 13 are shown broken away in order to give a clear view of the selector body 15 within each groove 55 a recess 70 is provided which defines a static latch formation.

Each pin 11, 12 and 13 is provided with a movable latch assembly 72 which is co-operable with each respective static latch.

Each movable latch assembly 72 preferably comprises a latch member (not shown in FIG. 8) which is moved between extended and retracted positions by motive means, preferably in the form of an electrostrictive or piezo-electric strip 62.

In the retracted position, each latch assembly lies within the periphery of the pin on which it is mounted so as to provide no obstruction to sliding movement of the body 15 along the pins 11, 12 and 13.

Figure 12:
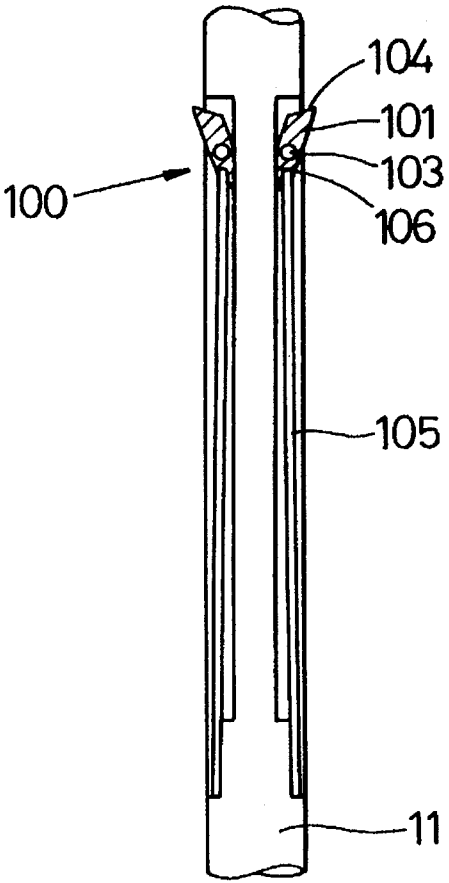
FIGS. 10, 11, 12 show alternative latch arrangements incorporated in the support members.
Figure 11:
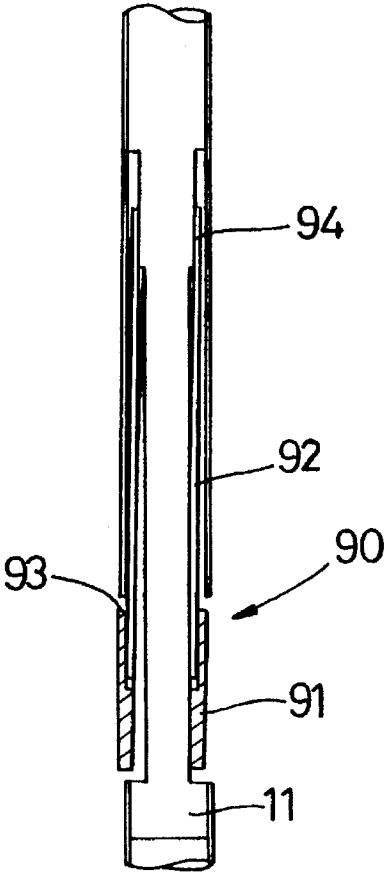
Figure 10:
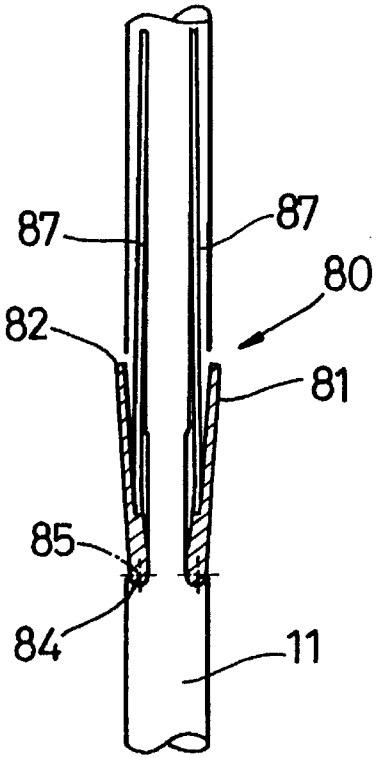

These alternative constructions of latch assemblies 80, 90 and 100 for mounting on pins 11, 12 and 13 are shown in respective FIGS. 10, 11 and 12.

In FIG. 10, each latch assembly 80 includes an elongate latch member 81 which extends longitudinally of the pin 11. The lower end of the latch member 81 is pivotally attached to the pin 11 so that the upper end 82 of the latch member 81 is movable between a retracted position (not shown) and an extended position as shown. The upper end 82 defines a latch formation for engagement with the selector body. The pivotal connection between the pin 11 and the lower end of the latch member 81 is preferably formed as shown by the provision of a recessed seat 84 in the pin 11 and a rounded end 85 of the member 81.

Such an arrangement not only permits pivotal movement but also enables loads carried by the latch member 81 to be transmitted to the pin 11 via the abutment between rounded end 85 and recessed seat 84.

The latch member 81 is preferably moved between its extended and retracted position by means of an electrostrictive or piezo-electric strip 82.

In the embodiment shown in FIG. 11 the latch member 91 is mounted on the lower end of an electrostrictive or piezo-electric strip 92. The strip 92 is secured to the pin 11 at its upper end 94 and is arranged to move the latch member 91 between an extended position (as seen on the left-hand side of FIG. 11 ) and a retracted position (as seen on the right-hand side of FIG. 11 ). The upper end 93 of the latch member 91 defines a latch formation for engagement with the selector body.

When engaged with the selector body, forces applied to the latch member 91 are transmitted to the pin 11 via the strip 92 and so places the strip 92 in tension. Preferably, at least in this embodiment, the strip 92 is reinforced with fibres such as carbon fibres in order to improve its load bearing capabilities when in tension.

In the embodiment shown in FIG. 12, the latch member 101 is pivotally mounted on the pin 11 via a pivot pin 103.

The latch member 101 has an upper end 104 which defines a latch formation for engagement with the selector body and is arranged so that on movement about its pivot axis the upper end 104 is moved between an extended position (as shown) and a retracted position (not shown). An electrostrictive or piezo-electric strip 105 is provided for moving the latch member between its extended and retracted positions. The latch member 101 preferably includes an abutment face 106 which abuts against the pin 11 when the latch member is in its extended position. In this way, loads applied to the latch member when in engagement with the selector body are transmitted directly to the pin 11 and so the strip 105 is isolated from such loads.

For all embodiments 80, 90 and 100, the respective latch members are preferably moulded from a suitable hard wearing plastics material.

In addition, for the embodiments of 80 and 100, the amount of displacement of the upper end of the latch member when moving between its retracted and extended positions in relation to the amount of displacement of the electrostrictive or piezo-electric strip may be varied by altering the distance of the upper end of the latch from its pivotal connection with the pin and/or altering the distance of the point of attachment of the strip from the pivotal connection.

Figure 7A:
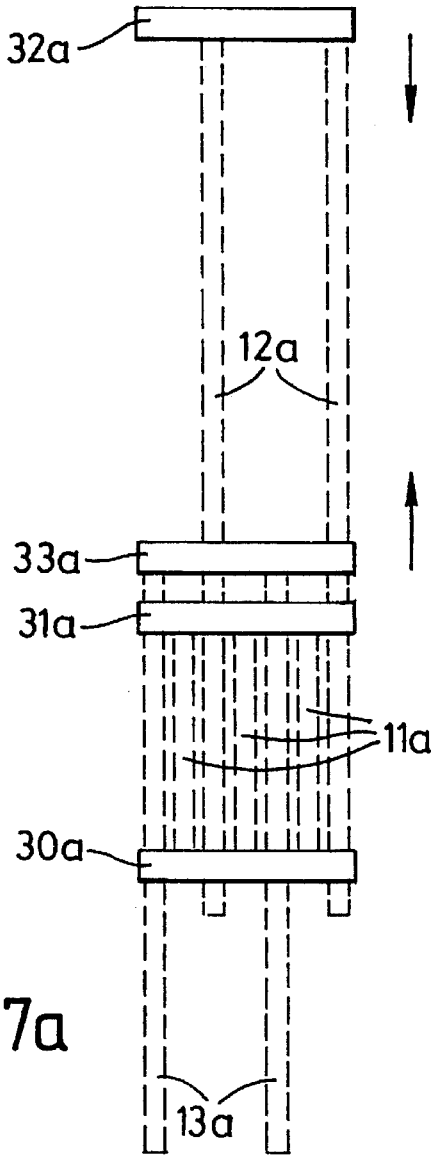
FIGS. 7*a*, 7*b* are schematic illustrations of a drive mechanism for driving the support members.
Figure 7B:
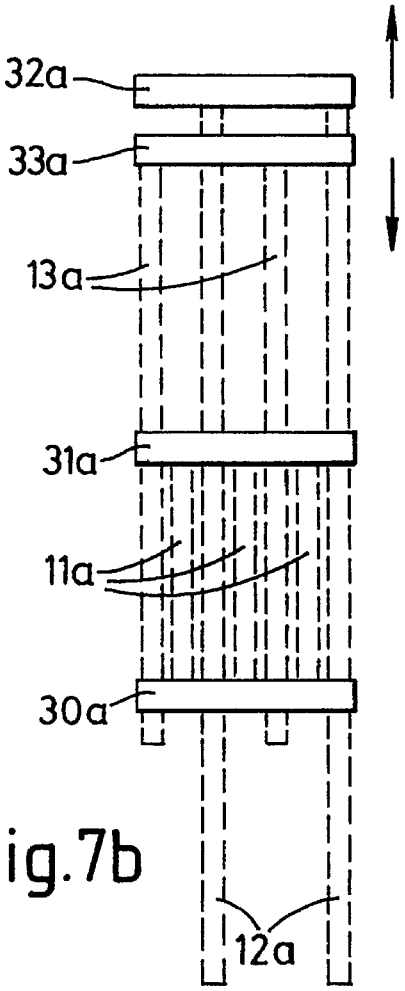

An arrangement for mounting and driving the pins 11, 12 and 13 is illustrated in FIGS. 7*c* and 7*b*.

A pair of spaced fixed boards 30*a*, 31*a* are provided between which the stationary pins 11 are fixed.

One end of pins 12 are mounted in a movable board 32*a* and one end of pins 13 are mounted in a movable board 33*a*.

The boards 32*a* and 33*a* are reciprocated between upper and lower limits of reciprocal movement by appropriate drive means (not shown) such as cam operated levers; those limits between shown in FIGS. 7*a*, 7*b*.

Accordingly the boards 30*c*, 31*a* serve to maintain regular spacing between pins 11, 12 and 13.

The length of pins 12 and 13 are chosen such that throughout their reciprocal movement they extend continuously between boards 30*a*, 31*a*.

The selector bodies 15 are located between the boards 30*a*, 31*a* and the position of latch assemblies 72 on respective pins 11, 12 and 13 is chosen so that these assemblies function to move the selector bodies 15 between upper and lower shed positions in between boards 30*a*, 31*a*.

We claim:

1. A jacquard mechanism for controlling shed selection of warp yarns, the mechanism including at least one selector body adapted for connection to a heald and mounted for movement between upper and lower shed positions, a plurality of elongate support members arranged side by side in a parallel relationship, the selector body being slidably mounted relative to said support members for longitudinal movement therealong, at least one of said plurality of support members being static and at least one other of the plurality of support members being mounted for longitudinal reciprocal movement, the selector body and support members including co-operable latch means operable between latch and unlatch positions causing selective engagement therebetween.

2. A mechanism according to claim 1, wherein said plurality of elongate support members comprise a static support member and a pair of reciprocally mounted support members, the support members of said pair being adapted to be reciprocated out of phase.

3. A mechanism according to claim 1 wherein the selector body is elongate and polygonal in cross-section.

4. A mechanism according to claim 1, including a plurality of selector bodies and associated support members, the selector bodies being arranged to be slidingly received on common support members to which other selected bodies are slidably connected.

5. A mechanism according to claim 4, wherein the cross-sectional shape of the selector bodies and location of support members is arranged to define a tessellated assembly.

6. A mechanism according to claim 1, wherein the cooperable latch means comprises a movable latch mounted on the selector body for co-operation with a static latch formation on an associated member.

7. A mechanism according to claim 6, wherein the movable latch includes a latch element movably mounted for movement between said latch and unlatch positions and motive means for moving the latch element between said positions.

8. A mechanism according to claim 7, wherein said motive means comprises an electrostrictive or piezo-electric strip.

9. A mechanism according to claim 1, wherein the co-operable latch means comprises a movable latch mounted on a support member for co-operation with a static latch formation on an associated selector body.

10. A mechanism according to claim 9, wherein the movable latch includes a latch element movably mounted for movement between said latch and unlatch positions and motive means for moving the latch element between said positions.

11. A mechanism according to claim 8, wherein said motive means comprises an electrostrictive or piezo-electric strip.

* * * * *

UNITED STATES PATENT AND TRADEMARK OFFICE

CERTIFICATE OF CORRECTION

PATENT NO. : 5,464,046

DATED : November 7, 1995

INVENTOR(S) : Jonathan F. McIntyre, et al.

It is certified that error appears in the above-indentified patent and that said Letters Patent is hereby corrected as shown below:

Column 8, claim 11, line 1, change " claim 8" to --claim 10--.

Signed and Sealed this

Twenty-seventh Day of February, 1996

*Attest:*

Bruce Lehman

BRUCE LEHMAN

*Attesting Officer*

*Commissioner of Patents and Trademarks*